US007335316B2

(12) United States Patent
Takei et al.

(10) Patent No.: US 7,335,316 B2
(45) Date of Patent: Feb. 26, 2008

(54) PLASTIC MAGNET PRECURSOR, PRODUCTION METHOD FOR THE SAME, AND PLASTIC MAGNET

(75) Inventors: Takako Takei, Tokyo (JP); Takeshi Araki, Tokyo (JP); Takanori Sone, Tokyo (JP); Hiroyuki Teramoto, Tokyo (JP); Takayuki Hanaki, Tokyo (JP); Noriaki Matsunaga, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 707 days.

(21) Appl. No.: 10/766,961

(22) Filed: Jan. 30, 2004

(65) Prior Publication Data

US 2006/0226393 A1 Oct. 12, 2006

(30) Foreign Application Priority Data

Feb. 3, 2003 (JP) ..... 2003-026119

(51) Int. Cl.
*H01F 1/00* (2006.01)

(52) U.S. Cl. ..... 252/62.54; 252/62.55

(58) Field of Classification Search ..... 252/62.54, 252/62.55, 62.52; 428/407
See application file for complete search history.

(56) References Cited

U.S. PATENT DOCUMENTS 5,200,270 A * 4/1993 Ishida et al. ..... 428/403
5,211,896 A * 5/1993 Ward et al. ..... 264/126
5,429,899 A * 7/1995 Chiba et al. ..... 430/108.3
5,888,416 A * 3/1999 Ikuma et al. ..... 252/62.54
6,893,580 B2 * 5/2005 Kawano et al. ..... 252/62.54

FOREIGN PATENT DOCUMENTS

| | | | |
|---|---|---|---|
| JP | 61-93603 | * | 5/1986 |
| JP | 4-11702 | | 1/1992 |
| JP | 04-11702 | * | 1/1992 |
| JP | 9-312207 | | 12/1997 |
| WO | WO 02/33002 | * | 4/2002 |

* cited by examiner

*Primary Examiner*—C. Melissa Koslow
(74) *Attorney, Agent, or Firm*—Leydig, Voit & Mayer, Ltd.

(57) ABSTRACT

A plastic magnet precursor which can be supplied in molding a plastic magnet with a constant composition without requiring kneading in which a resin is melted and sheared. Through injection molding using the precursor, a plastic magnet having little deterioration of magnetic properties and a small variation in quality is obtained. The plastic magnet precursor according to the present invention includes an Nd—Fe—B isotropic magnet powder and a ferrite anisotropic magnet powder subjected to coating with a titanate coupling agent, and a thermoplastic resin powder adhered around the magnet powder.

8 Claims, 8 Drawing Sheets

PLASTIC MAGNET PRECURSOR, PRODUCTION METHOD FOR THE SAME, AND PLASTIC MAGNET

BACKGROUND OF THE INVENTION

1. Field of the Invention

The present invention relates to a plastic magnet precursor containing a magnet powder and a thermoplastic resin powder, a production method therefor, and a plastic magnet produced by the method.

2. Description of the Related Art

Conventionally, a plastic magnet is produced by compression molding, extrusion molding, or injection molding using a mixture of a magnet powder and a thermoplastic resin powder, or a compound of a granulated product, in which the granulated product is prepared by crushing or breaking through strand cutting, underwater cutting, hot cutting etc., a kneaded product obtained by kneading the mixture (for example, see JP 09-312207 A).

When using a mixture of the above composition as a plastic magnet precursor which is a raw material for a plastic magnet, a difference in specific gravities of a magnet powder and a thermoplastic resin powder becomes extremely large, and thus the magnet powder and the thermoplastic resin powder are liable to separate due to the difference in their specific gravities. There arises a problem in that it is difficult to continuously supply the magnet powder and the thermoplastic resin powder to a next process step in a state retaining a constant ratio.

Further, when using a compound as a plastic magnet precursor which is a raw material for a plastic magnet, the compound itself is subjected to thermal history and shearing history in a kneading step. Therefore, there arises a problem in that heat deterioration and oxidation of the thermoplastic resin powder and destruction of the magnet powder occur, and acceleration of the oxidation of the thermoplastic resin powder due to the magnet powder is considerable.

SUMMARY OF THE INVENTION

The present invention has been made in view of solving the problems described above. It is an object of the present invention to provide a plastic magnet precursor which is obtained by allowing supply of a thermoplastic resin powder and a magnet powder at a constant ratio while melting the thermoplastic resin powder and without requiring a kneading step in which the magnet powder is sheared when molding a plastic magnet.

Further, it is another object of the present invention to provide a production method for a plastic magnet precursor capable of assuredly adhering the thermoplastic resin powder to the magnet powder.

Further, it is still another object of the present invention to provide a plastic magnet with little degradation of magnetic properties and highly stable quality.

A plastic magnet precursor according to the present invention includes a thermoplastic resin powder adhering around at least one kind of a magnet powder.

Further, a plastic magnet precursor according to the present invention includes at least one kind of a magnet powder adhering around a thermoplastic resin powder.

A production method for the plastic magnet precursor according to the present invention includes:

heating a magnet powder in advance to a temperature of which a contacting surface of a thermoplastic resin powder melts as the magnet powder comes in contact with the thermoplastic resin powder;

mixing the heated magnet powder with the thermoplastic resin powder; and melting the thermoplastic resin powder by heat of the magnet powder to adhere thereto.

A production method for the plastic magnet precursor according to the present invention includes:

mixing a magnet powder, coated with a coupling agent, with a thermoplastic resin powder at a temperature of a softening point of the coupling agent or above and a melting temperature of the thermoplastic resin powder or below; and adhering the thermoplastic resin powder to the softened coupling agent.

A production method for the plastic magnet precursor according to the present invention includes:

activating a thermoplastic resin powder;

mixing a thermoplastic resin powder with the magnet powder; and adhering the activated thermoplastic resin powder to the magnet powder.

A production method of the plastic magnet precursor according to the present invention includes:

activating at least one of a thermoplastic resin powder and a magnet powder both coated with a coupling agent;

mixing the thermoplastic resin powder with the magnet powder; and bonding the thermoplastic resin powder with the magnet powder through the coupling agent.

A plastic magnet according to the present invention is formed by injection molding of the plastic magnet precursor.

DETAILED DESCRIPTION OF THE INVENTION

Hereinafter, examples of the present invention will be described. In each of the examples, same members and same parts will be described using the same reference symbols.

EXAMPLE 1

An Nd—Fe—B isotropic magnet powder having a maximum length of less than 1,000 μm and an average thickness of 30 μm, which is produced by a liquid quenching method, and a ferrite anisotropic magnet powder having an average particle size of 1.4 μm were subjected to surface coating treatment using isopropyl-triisostearoyl titanate which is a titanate coupling agent. A coating treatment method for a surface of each of the magnet powders includes the following.

The magnet powder was stirred for 30 minutes in a solution in which the titanate coupling agent was diluted with an n-butyl acetate solvent. An amount of the coupling agent used was 0.5 parts by weight with respect to 100 parts by weight of the magnet powder. A volume fraction of the magnet powder to the solution was 0.05. After stirring, the magnet powder was settled by leaving to stand, and a supernatant liquid alone was removed. After removing the unnecessary solution by filtrating of the remaining slurry substance under reduced pressure and drying by heating under vacuum at 80° C., inert gas replacement was carried out. From the above, the surface of the magnet powder was coated with the coupling agent.

In a Henschel mixer replaced with inert gas, 0.2 parts by weight of 2',3-bis[[3-[3,5-di-tert-butyl-4-hydroxyphenyl] propionyl]]propionohydrazine which is a metal deactivator, 0.1 parts by weight of N,N'-hexane-1,6-diylbis[3-(3,5-di-tert-butyl-4-hydroxyphenylpropionamide)] which is a hindered phenol antioxidant, 0.1 parts by weight of tris(2,4-di-tert-butylphenyl)phosphite which is a phosphorus antioxidant, and 0.1 parts by weight of a reaction product of 3-hydroxy-5,7-di-tert-butylfuran-2-one which is a lactone antioxidant and xylene with respect to 100 parts by weight of a polyamide 12 powder which is a thermoplastic resin powder were added and stirred.

Further, two kinds of the above magnet powders coated with the coupling agent were added here and stirred at 60° C., thereby obtaining a plastic magnet precursor for injection molding.

A weight ratio of the Nd—Fe—B magnet powder, the ferrite magnet powder, and the thermoplastic resin powder was 54.5 wt % to 36 wt % to 9.5 wt %.

Next, a procedure for producing the plastic magnet from the above plastic magnet precursor through injection molding will be described.

Figure 1:
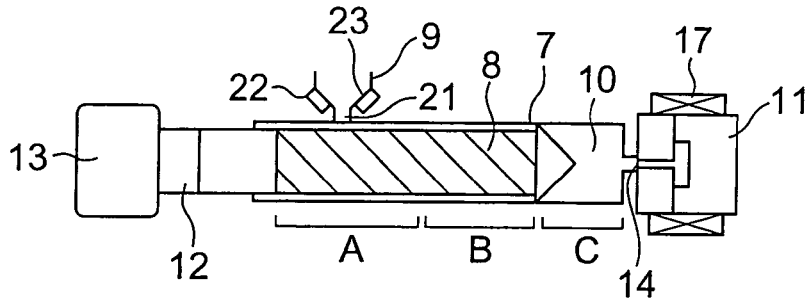
FIG. 1 is a structural diagram of an injection molding machine in which a plastic magnet precursor according to Examples 1 to 9 is charged.

FIG. 1 is a structural diagram of an injection molding machine for producing a plastic magnet.

The plastic magnet precursor is first charged from a hopper 9 in which a fluorine resin coating is formed on a surface thereof through a charging port 21 to a heating cylinder 7. The hopper 9 is provided with a vibration mechanism 22, enabling prevention of a bridge formation inside the hopper 9 by the powder-type plastic magnet precursor.

For the vibration mechanism, a method using a piezoelectric actuator or a magnetostrictive actuator and a method of tapping a hammer by an electromagnetic motor or of rotating an eccentric rotor can be used.

A heating zone A and a heating zone B of the heating cylinder 7 are heated to a temperature of 230° C. by a heater. The charged plastic magnet precursor is plasticized, receiving heat, and is conveyed to a reservoir zone 10 (heating zone C) in the front portion of the heating cylinder 7 by a screw 8 which rotates through a screw rotating mechanism 12. After reaching a required amount, the plastic magnet precursor inside the reservoir zone 10 heated to 240° C. is pressurized through a pressurizing mechanism 13, and is spouted and injected from an injection port 14 at the tip of the heating cylinder 7 into a mold 11. The mold is heated to 50 to 180° C. as required to prevent surface roughening of the surface of the molded product during injection.

The mold 11 is provided with ring-shaped electromagnetic coils 17. An electric current is passed through the electromagnetic coils 17 to produce a magnetic field of 1.5 T, thereby producing a plastic magnet having a diameter of 30 mm and a thickness of 8 mm and having a magnetic anisotropy in the direction of the film thickness owing to an orientation of magnet powders in the magnetic field of the coils.

Magnetic properties of the plastic magnet are shown in Table 1.

TABLE 1

| | Remanent magnetization (T) | Coercive force Hc (kA/m) | Maximum energy product BHmax ($KJ/m^3$) |
|---|---|---|---|
| Example 1 | 0.407 | 638 | 30.0 |
| Comparative Example 1 | 0.399 | 619 | 28.8 |
| Example 2 | 0.402 | 627 | 29.4 |
| Comparative Example 2 | 0.394 | 608 | 27.3 |
| Example 3 | 0.463 | 788 | 38.1 |
| Comparative Example 3 | 0.453 | 761 | 36.3 |
| Example 4 | 0.571 | 1020 | 59.5 |
| Comparative Example 4 | 0.559 | 986 | 57.0 |
| Example 5 | 0.512 | 774 | 45.6 |
| Comparative Example 5 | 0.502 | 749 | 43.9 |
| Example 6 | 0.575 | 1050 | 60.8 |
| Comparative Example 6 | 0.564 | 1015 | 58.5 |
| Example 7 | 0.724 | 1057 | 92.5 |
| Comparative Example 7 | 0.708 | 1023 | 88.2 |
| Example 8 | 0.606 | 913 | 68.4 |

TABLE 1-continued

| | Remanent magnetization (T) | Coercive force Hc (kA/m) | Maximum energy product BHmax ($KJ/m^3$) |
|---|---|---|---|
| Comparative Example 8 | 0.593 | 883 | 65.3 |
| Example 9 | 0.615 | 735 | 69.0 |
| Comparative Example 9 | 0.603 | 713 | 66.0 |

As a comparative example, two kinds of the magnet powders coated with the above coupling agent and the thermoplastic resin powder, to which the above antioxidants were added, were kneaded and extruded into strands using a biaxial extruder, and pellets of the plastic magnet precursor were produced using a pelletizer. Injection molding was carried out using the pellets to produce a plastic magnet having a diameter of 30 mm and a thickness of 8 mm.

Magnetic properties thereof are shown in Table 1 as Comparative Example 1.

From the example, the plastic magnet of Example 1 excels in remanent magnetization, coercive force, and maximum energy product compared with that of Comparative Example 1. Therefore, it was found out that the plastic magnet of Example 1 excels in magnetic properties compared with that of Comparative Example 1.

Figure 2A:
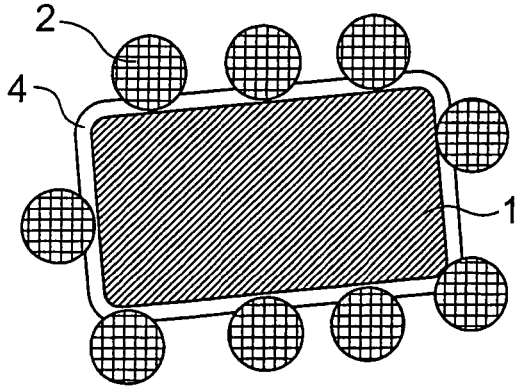
FIG. 2A is an explanatory diagram of a plastic magnet precursor according to Examples 1 and 3.

FIG. 2A is an explanatory diagram of the plastic magnet precursor according to Example 1 and shows a state in which a thermoplastic resin powder 2 is bonded to magnet powders 1 through a coupling agent 4 covering surfaces of the magnet powders 1 having a larger size than the thermoplastic resin powder 2.

Figure 2B:
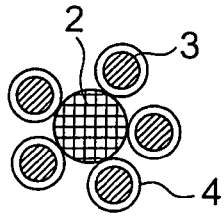
FIG. 2B is an explanatory diagram of a plastic magnet precursor according to Examples 1 and 3.

In addition, as shown in FIG. 2B, the thermoplastic resin powder 2 may be bonded to magnet powders 3 through the coupling agent 4 covering surfaces of the magnet powders 3 having a smaller size than the thermoplastic resin powder 2.

The plastic magnet precursor according to Example 1 includes the thermoplastic resin powder 2 bonded around two kinds of the magnet powders 1 through the coupling agent 4. A kneading step is not included in a production process of the plastic magnet precursor, enabling prevention of heat deterioration and oxidation of the thermoplastic resin powder and destruction of the magnet powder.

Further, the plastic magnet precursor having an even and stable mixing ratio of the thermoplastic resin powder and the magnet powders can be continuously supplied to an injection molding machine, similar to conventional compounds and pellets.

Further, the plastic magnet formed by injection molding using the plastic magnet precursor has little deterioration of magnetic properties and a small variation in quality.

Further, two kinds of the magnet powders 1 are coated with the coupling agent 4 which bonds the magnet powders 1 and the thermoplastic resin powder 2. Therefore, adhesion between the magnet powders 1 and the thermoplastic resin powder 2 is reinforced, thus enabling prevention of falling off of the powders after mixing.

Further, the surfaces of the magnet powders 1 are coated with the coupling agent 4, allowing prevention of deterioration of the resin caused by oxidation due to the magnet powders 1. For this reason, quality stability of the plastic magnet precursor enhances, and as a result, the quality stability of the plastic magnet enhances.

Further, for the plastic magnet precursor according to Example 1, two kinds of the magnet powders 1 coated with the coupling agent 4 were mixed with the thermoplastic resin powder 2 at a temperature of the softening point of the coupling agent 4 or above and a melting temperature of the thermoplastic resin powder or below. Therefore, the magnet powders 1 were joined to the coupling agent 4 by a hydrolyzable group of the coupling agent 4 . The thermoplastic resin powder 2 was joined to the coupling agent 4 by an organic functional group of the coupling agent 4, thereby producing a plastic magnet precursor for injection molding without the kneading step.

Further, the above plastic magnet precursor contains an antioxidant, thus enabling prevention of an oxidation of the thermoplastic resin during production step of the precursor and injection molding. Therefore, fluidity of the resin improves during injection molding, and an orientation of the magnet powders 1 inside the mold 11 enhances. As a result, a plastic magnet having even better magnetic properties can be obtained.

Further, the above plastic magnet precursor contains a metal deactivator, thus enabling prevention of an oxidation of the resin due to the magnet powders during the production step of the precursor and injection molding. For this reason, the fluidity of the resin further improves during injection molding, and the orientation of the magnet powders inside the mold 11 further enhances. As a result, a plastic magnet having even better magnetic properties can be obtained.

EXAMPLE 2

A powder (return material) obtained by pulverizing molded sprue and runner generated during injection molding of Example 1 and the plastic magnet precursor for injection molding of Example 1 were mixed and stirred at a weight ratio of 3 to 7 to obtain a plastic magnet precursor.

A plastic magnet was obtained from the plastic magnet precursor using an injection molding machine shown in FIG. 1. Heating temperatures of the heating zones A and B of the heating cylinder 7, a heating temperature of the reservoir zone 10, and the intensity of the magnetic field applied to the mold 11 were the same as those of Example 1. The produced plastic magnet also had the same size as that of Example 1.

Magnetic properties of the plastic magnet are shown in Table 1.

As a comparative example, a powder obtained by pulverizing molded sprue and runner generated during injection molding of Comparative Example 1 and the pellets of Comparative Example 1 were mixed and stirred in a weight ratio of 3 to 7 to obtain a plastic magnet precursor. Injection molding was carried out using the plastic magnet precursor under the same conditions, to produce a plastic magnet having the same shape as that of Example 2.

Magnetic properties thereof are shown in Table 1.

As is apparent from the table, the plastic magnet of Example 2 excels in remanent magnetization, coercive force, and maximum energy product compared with that of Comparative Example 2. Therefore, it was found out that the plastic magnet of Example 2 excels in magnetic properties compared with that of Comparative Example 2.

EXAMPLE 3

An Nd—Fe—B isotropic magnet powder having a maximum length of less than 1,000 μm and an average thickness of 30 μm, which is produced by liquid quenching, was subjected to coating treatment of a surface using a γ-ureidopropyl-triethoxysilane which is a silane coupling agent.

A coating process thereof first includes diluting of the coupling agent of 10 ml with ethyl alcohol of 100 ml. Then, the coupling agent solution was sprayed to the magnet powder. The rate of the coupling agent to the magnet powder was 0.001 by weight. Finally, ethyl alcohol was removed by heating under vacuum at 80° C., to coat the surface of the magnet powder with the coupling agent.

Further, in a Henschel mixer replaced with inert gas and heated to 80° C., which is a temperature of a softening point of the coupling agent or above and a melting temperature of the thermoplastic resin powder or below, 0.2 parts by weight of 2',3-bis[[3-[3,5-di-tert-butyl-4-hydroxyphenyl]propionyl]]propionohydrazine which is a metal deactivator, 0.15 parts by weight of ethylenebis(oxyethylene)bis[3-(5-tert-butyl-4-hydroxy-m-tolyl)propionate] which is a hindered phenol antioxidant, 0.1 parts by weight of tetrakis(2,4-di-tert-butylphenyl)[1,1-biphenyl]-4,4'-diylbisphosphonite which is a phosphorus antioxidant, and 0.1 parts by weight of a reaction product of 3-hydroxy-5,7-di-tert-butylfuran-2-one which is a lactone antioxidant and xylene with respect to 100 parts by weight of a polyamide 6 powder which is a thermoplastic resin powder were added and stirred.

Next, to the thermoplastic resin powder containing a metal deactivator and antioxidants, the magnet powder having a surface coated with the above coupling agent was added so that a weight ratio of the thermoplastic resin powder and the magnet powder was 13 wt % to 87 wt %. The mixture was further mixed and stirred to produce a plastic magnet precursor for injection molding.

A plastic magnet was obtained from the plastic magnet precursor using an injection molding machine shown in FIG. 1. The heating temperatures of the heating zones A and B of the heating cylinder 7 and the heating temperature of the reservoir zone 10 were the same as those of Example 1; however, a magnetic field was not applied to the mold 11. The produced plastic magnet also had the same size as that of Example 1.

As a comparative example, the magnet powder coated with the above coupling agent and the resin powder, to which the above antioxidants were added, and the above metal deactivation were kneaded and extruded into strands using a biaxial extruder, and pellets of the plastic magnet precursor were produced using a pelletizer. Injection molding was carried out similarly using the pellets to produce a plastic magnet having the same size as that of Example 3.

Magnetic properties of the plastic magnet are shown in Table 1.

As is apparent from the table, the plastic magnet of Example 3 excels in remanent magnetization, coercive force, and maximum energy product compared with that of Comparative Example 3. Therefore, it was found out that the plastic magnet of Example 3 excels in magnetic properties compared with that of Comparative Example 3.

EXAMPLE 4

An Sm—Fe—N anisotropic magnet powder having an average particle size of 3 μm, which is produced through reduction-diffusion process, was heated to 275° C., which is close to a melting point of the thermoplastic resin, in an inert gas atmosphere.

Next, the heated Sm—Fe—N magnet powder was added to a polyphenylenesulfide powder which is a thermoplastic resin powder, to which 0.2 parts by weight of 2',3-bis[[3-[3,5-di-tert-butyl-4-hydroxyphenyl]propionyl]]propionohydrazide which is a metal deactivator with respect to 100 parts by weight of the thermoplastic resin powder was added and stirred at high speed at room temperature, to obtain a plastic magnet precursor for injection molding.

A weight ratio of the polyphenylenesulfide powder and the Sm—Fe—N magnet powder was 15 wt % to 85 wt %.

A plastic magnet was obtained from the plastic magnet precursor using an injection molding machine shown in FIG. 1. The heating temperature of the heating zone A of the heating cylinder 7 was 290° C., the heating temperature of the heating zone B thereof was 300° C., and the heating temperature of the heating zone C, the reservoir zone 10, thereof was 310° C. A magnetic field of 1.5 T was applied to the mold 11.

Further, the produced plastic magnet had the same size as that of Example 1.

As a comparative example, the magnet powder and the thermoplastic resin powder, to which the above metal deactivator was added, were kneaded and extruded into strands using a biaxial extruder, and pellets of the plastic magnet precursor were produced using a pelletizer. An injection molding was carried out similarly using the pellets to obtain a plastic magnet having the same shape as that of Example 4.

Magnetic properties thereof are shown in Table 1 as Comparative Example 4.

As is apparent from the example, the plastic magnet of Example 4 excels in remanent magnetization, coercive force, and maximum energy product compared with that of Comparative Example 4. Therefore, it was found out that the plastic magnet of Example 4 excels in magnetic properties compared with that of Comparative Example 4.

Figure 3:
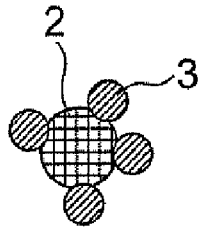
FIG. 3 is an explanatory diagram of a plastic magnet precursor according to Example 4.

FIG. 3 is an explanatory diagram of a plastic magnet precursor according to Example 4 and shows a state in which the thermoplastic resin powder 2 melts at a contacting surface with the magnet powder having a smaller size than the resin powder 2 to adhere to the magnet powder.

The plastic magnet precursor according to Example 4 includes the magnet powder 1 adhered around the thermoplastic resin powder 2. Similar to Examples 1 to 3, a kneading step is not included in the production process of the plastic magnet precursor, enabling prevention of heat deterioration and oxidation of the resin and destruction of the magnet powder.

Further, similar to Examples 1 to 3, the plastic magnet precursor having an even and stable mixing ratio of the thermoplastic resin powder and the magnet powder can be continuously supplied to an injection molding machine.

Further, the plastic magnet formed by injection molding using the plastic magnet precursor has little deterioration of magnetic properties and a small variation in quality.

EXAMPLE 5

An Nd—Fe—B isotropic magnet powder having an average particle size of 30 μm, which is produced by liquid quenching, was heated to 180° C., which is close to a melting point of a polyamide 12 resin, a thermoplastic resin powder, in an inert gas atmosphere.

Then, to the heated Nd—Fe—B isotropic magnet powder, 0.2 parts by weight of 2',3-bis [[3-[3,5-di-tert-butyl-4-hydroxyphenyl]propinyl]]propionohydrazide which is a metal deactivator, 0.1 parts by weight of N,N'-hexane-1, 6-diylbis [3-(3,5-di-tert-butYl-4-hydroxyphenylpropionamide)] which is a hindered phenol antioxidant, 0.15 parts by weight of tris(2,4-di-tert-butylphenyl)phosphite which is a phosphorus antioxidant, and 0.05 parts by weight of a reaction product of 3-hydroxy-5,7-di-tert-butylfuran-2-one which is a lactone antioxidant and xylene were added. Then, the magnetic powder was added into the polyamide 12 resin powder, and stirred at high speed at room temperature in an inert gas atmosphere, to produce a plastic magnet precursor for injection molding.

A weight ratio of the polyamide 12 thermoplastic resin powder and the Nd—Fe—B magnet powder was 10 wt % to 90 wt %.

A plastic magnet was obtained from the plastic magnet precursor using an injection molding machine shown in FIG. 1. The heating temperature of the heating zone A of the heating cylinder 7 was 230° C., the heating temperature of the heating zone B thereof was 230° C., and the heating temperature of the heating zone C, the reservoir zone 10, thereof was 240° C. A magnetic field was not applied to the mold 11.

Further, the produced plastic magnet had the same size as that of Example 1.

As a comparative example, a mixture of the magnet powder and the thermoplastic resin powder, to which the above antioxidants and the above metal deactivator were added, were kneaded and extruded into strands using a biaxial extruder, and pellets of the plastic magnet precursor were produced using a pelletizer.

An injection molding was carried out similarly using the pellets to obtain a plastic magnet having the same shape as that of Example 5.

Magnetic properties thereof are shown in Table 1 as Comparative Example 5.

As is apparent from the example, the plastic magnet of Example 5 excels in remanent magnetization, coercive force, and maximum energy product compared with that of Comparative Example 5. Therefore, it was found out that the plastic magnet of Example 5 excels in magnetic properties compared with that of Comparative Example 5.

Figure 4:
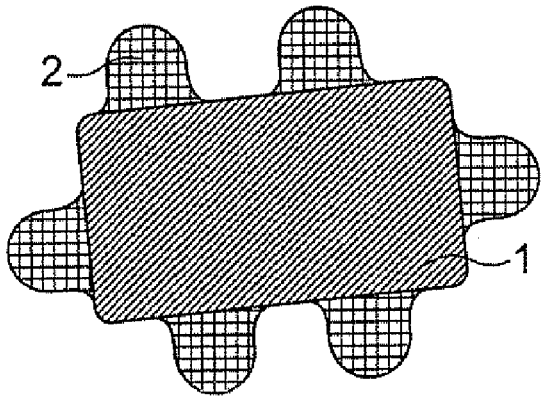
FIG. 4 is an explanatory diagram of a plastic magnet precursor according to Example 5.

FIG. 4 is an explanatory diagram of the plastic magnet precursor according to Example 5 and shows a state in which the thermoplastic resin powder 2 melts at a contacting surface with the magnet powder 1 having a larger size than the resin powder 2 to adhere to the magnet powder.

The plastic magnet precursor according to Example 5 includes the thermoplastic resin powder 2 adhered around the magnet powder 1. Similar to Examples 1 to 4, a kneading step is not included in the production process of the plastic magnet precursor, enabling prevention of heat deterioration and oxidation of the resin and destruction of the magnet powder.

Further, similar to Examples 1 to 4, the plastic magnet precursor having an even and stable mixing ratio of the thermoplastic resin powder and the magnet powder can be continuously supplied to an injection molding machine.

Further, the plastic magnet formed by injection molding using the plastic magnet precursor has little deterioration of magnetic properties and a small variation in quality.

EXAMPLE 6

To 100 parts by weight of an S—Fe—N anisotropic magnet powder having an average particle size of 3 μm which is produced through reduction-diffusion , a solution, in which 0.2 parts by weight of acetoalkoxy aluminum diisopropylate, which is an aluminum coupling agent, was diluted with isopropyl alcohol to a concentration of 2 ml/100 ml, was added to prepare a slurry, and the mixture was mixed and stirred. Then, the mixture was stirred under vacuum at 80° C. using a vacuum heat mixing stirrer to remove isopropyl alcohol.

Further, ultraviolet light with a wavelength of 254 nm was irradiated for 90 seconds to activate the coupling agent covering the magnet powder.

Next, the Sm—FE—N magnet powder coated with the activated coupling agent was added to a polyphenylene-sulfide powder, to which 0.2 parts by weight of 2',3-bis[[3-[3,5-di-tert-butyl-4-hydroxyphenyl]propionyl]]propionohydrazide which is a metal deactivator with respect to 100 parts by weight of the thermoplastic resin was added and stirred at high speed at room temperature, to obtain a plastic magnet precursor for injection molding.

A weight ratio of the polyphenylenesulfide powder which is a thermoplastic resin powder and the Sm—FE—N magnet powder was 15 wt % to 85 wt %.

A plastic magnet was obtained from the plastic magnet precursor using an injection molding machine shown in FIG. 1. The heating temperature of the heating zone A of the heating cylinder 7 was 290° C., the heating temperature of the heating zone B thereof was 300° C., and the heating temperature of the heating zone C, the reservoir zone 10, thereof was 310° C. A magnetic field of 1.5 T was applied to the mold 11.

Further, the produced plastic magnet had the same size as that of Example 1.

As a comparative example, the magnet powder coated with the activated coupling agent and the thermoplastic resin powder, to which the above metal deactivator was added, were kneaded and extruded into strands using a biaxial extruder, and pellets of the plastic magnet precursor were produced using a pelletizer.

An injection molding was carried out similarly using the pellets to obtain a plastic magnet having the same size as that of Example 5.

Magnetic properties thereof are shown in Table I as Comparative Example 6.

As is apparent from the example, the plastic magnet of Example 6 excels in remanent magnetization, coercive force, and maximum energy product compared with that of Comparative Example 6. Therefore, it was found out that the plastic magnet of Example 6 excels in magnetic properties compared with Comparative Example 6.

Figure 5A:
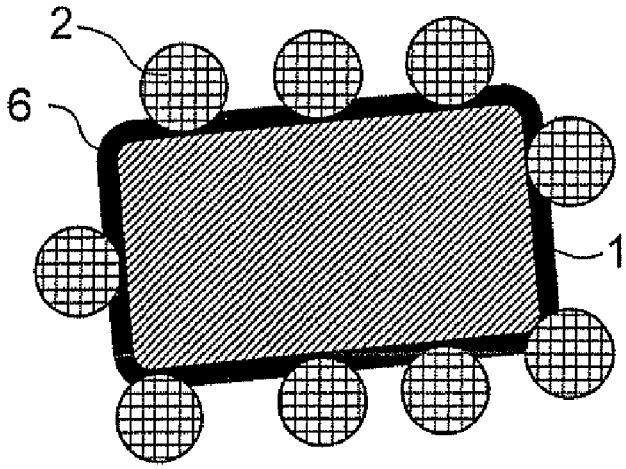
FIG. 5A is an explanatory diagram of a plastic magnet precursor according to Example 6.

FIG. 5A is an explanatory diagram showing a state of the thermoplastic resin powder 2 bonding to the magnet powder 1 through the activated coupling agent 6 covering the magnet powder 1 having a larger size than the thermoplastic resin powder 2 and may be showing the above thermoplastic resin powder itself.

Figure 5B:
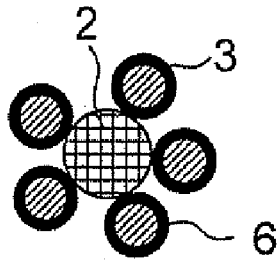
FIG. 5B is an explanatory diagram of a plastic magnet precursor according to Example 6.

FIG. 5B is an explanatory diagram of the plastic magnet precursor according to Example 6 and shows a state of the magnet powder 3 bonding to the thermoplastic resin powder 2 through the activated coupling agent 6 covering the magnet powder 3 having a smaller size than the thermoplastic resin powder 2.

The plastic magnet precursor according to Example 6 includes the thermoplastic resin powder 2 adhered to the coupling agent 6 coated around the magnet powder 1. Similar to Example 1, a kneading step is not included in the production process of the plastic magnet precursor, enabling prevention of heat deterioration and oxidation of the resin and destruction of the magnet powder.

The plastic magnet precursor having an even and stable mixing ratio of the thermoplastic resin powder and the magnet powder can be continuously supplied to an injection molding machine.

Further, the plastic magnet formed by injection molding using the plastic magnet precursor has little deterioration of magnetic properties and a small variation in quality.

Further, a surface of the coupling agent 6 is activated by irradiating an ultraviolet ray with a wavelength of 254 nm for 90 seconds, enabling easy adhering of the thermoplastic resin powder to the coupling agent 6 without a need of softening the coupling agent 6, by heating as in Examples 1 and 3.

Figure 14:
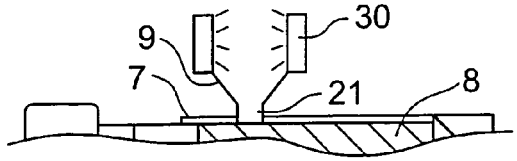
FIG. 14 is a partial structural diagram of an injection molding machine provided with an ultraviolet ray irradiator.

An ultraviolet light irradiator 30 as an activation means may be provided in the hopper 9 for activation of the coupling agent covering the surface of the magnet powder 1 as shown in FIG. 14.

EXAMPLE 7

1 part by weight of isopropyl tri(N-aminoethyl-aminoethyl)titanate, which is a titanate coupling agents with respect to 100 parts by weight of a magnet powder was diluted with methyl alcohol to concentration of 20 ml/100 ml. The solution was sprayed on an Nd—Fe—B anisotropic magnet powder having an average particle size of 50 μm, which is produced by an HDDR method. Then, the mixture was heated under vacuum at 60° C. using a vacuum heat mixing stirrer to remove methyl alcohol, thereby producing a magnet powder having a surface thereof coated with the coupling agent.

Next, to a polyamide 12 resin powder, a thermoplastic resin powder having a surface activated with irradiation of an ultraviolet ray with a wavelength of 185 nm for 90 seconds, stirred at high speed, [[3,5-bis(1,1-dimethylethyl)-4-hydroxyphenyl]methyl]phosphonate which is an antioxidant was added in a proportion of 0.2 parts by weight with respect to 100 parts by weight of the thermoplastic resin along with addition of the magnet powder. Then, the mixture was stirred at high speed for 10 minutes at 30° C.

From the above, a plastic magnet precursor for injection molding was produced. A weight ratio of the polyamide 12 powder and the Nd—Fe—B magnet powder was 8 wt % to 92 wt %.

A plastic magnet was obtained from the plastic magnet precursor using an injection molding machine shown in FIG. 1. The heating temperature of the heating zone A of the heating cylinder 7 was 230° C., the heating temperature of the heating zone B thereof was 230° C., and the heating temperature of the heating zone C, the reservoir zone 10, thereof was 240° C. A magnetic field of 1.5 T was applied to the mold 11. Further, the produced plastic magnet had the same size as that of Example 1.

As a comparative example, the magnet powder coated with the above coupling agent and the activated thermoplastic resin powder, to which the above antioxidants were added, were kneaded and extruded into strands using a biaxial extruder, and pellets of the plastic magnet precursor were produced using a pelletizer. Injection molding was carried out similarly using the pellets to produce a plastic magnet having the same size as that of Example 7.

Magnetic properties thereof are shown in Table 1 as Comparative Example 7.

As is apparent from the example, the plastic magnet of Example 7 excels in remanent magnetization, coercive force, and maximum energy product compared with that of Comparative Example 7. Therefore, it was found out that the plastic magnet of Example 7 excels in magnetic properties compared with that of Comparative Example 7.

Figure 6A:
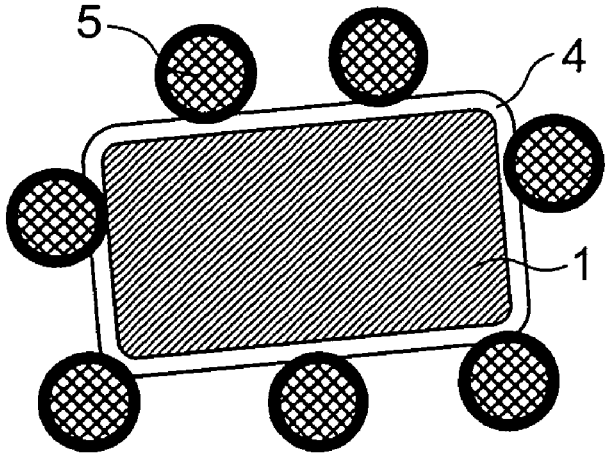
FIG. 6A is an explanatory diagram of a plastic magnet precursor according to Examples 7, 8, and 9.

FIG. 6A is an explanatory diagram of the plastic magnet precursor according to Example 7 and shows a state of a thermoplastic resin powder 5 bonding to the magnet powder 1 having a larger size than the thermoplastic resin powder 5, which has an activated surface, through the coupling agent 4.

Figure 6B:
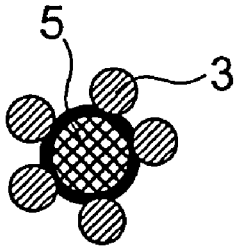
FIG. 6B is an explanatory diagram of a plastic magnet precursor according to Examples 7, 8, and 9.

FIG. 6B is an explanatory diagram showing a state of the magnet powder 3 having a smaller size than the thermoplastic resin powder 5 adhering to the thermoplastic resin powder 5, which has an activated surface and may be showing the above magnet powder itself.

The plastic magnet precursor according to Example 7 includes the thermoplastic resin powder 5, which has an activated surface, adhered around the magnet powder 1 through the coupling agent 4. Similar to the above Example 1, a kneading step is not included in the production process of the plastic magnet precursor, enabling prevention of heat deterioration and oxidation of the resin and destruction of the magnet powder in the same step.

Further, the plastic magnet precursor having an even and stable mixing ratio of the thermoplastic resin powder and the magnet powder can be continuously supplied to an injection molding machine.

Further, the plastic magnet formed by injection molding using the plastic magnet precursor has little deterioration of magnetic properties and a small variation in quality.

Further, the surface of the thermoplastic resin powder 5 is activated by irradiating an ultraviolet ray with a wavelength of 185 nm for 90 seconds, enabling easy adhering of the thermoplastic resin powder 5 to the surface of the magnet powder 1 without a need of softening the coupling agent 6 by heating as in Examples 1 and 3.

In Example 7, the surface of the thermoplastic resin powder may be activated through an ultraviolet irradiation treatment with a shortwave of 254 nm or less, preferably with a shortwave of 185 nm or less.

Further, the ultraviolet irradiation treatment may be carried out not only for the thermoplastic resin powder, but also for the coupling agent.

EXAMPLE 8

1 part by weight of isopropyl tris(dodecylbenzenesulfonyl)titanate, which is a titanate coupling agent, with respect to 100 parts by weight of a magnet powder was diluted with methyl alcohol to concentration of 20 ml/100 ml. The solution was sprayed to an Sm—Co anisotropic magnet powder having an average particle size of 3 μm and an S—Fe—N anisotropic magnet powder having an average particle size of 5 μm, which is produced through a reduction-diffusion process. Then, the mixture was heated under vacuum at 60° C. using a vacuum heat mixing stirrer to remove methyl alcohol, thereby producing a magnet powder coated with the coupling agent.

Next, to a polyphenylenesulfide powder stirred at high speed which is a thermoplastic resin powder having a surface activated with irradiation of an ultraviolet ray with a wavelength of 185 nm for 90 seconds, 0.2 parts by weight of octadecyl 3-(3,5-di-tert-butyl-4-hydroxyphenyl)propionate which is a hindered phenol antioxidant was added with respect to 100 parts by weight of the resin. Then, two kinds of the magnet powders coated with the coupling agent were added, and stirred at high speed for 10 minutes at 30° C.

From the above, a plastic magnet precursor for injection molding was produced. A weight ratio of the polyphenylenesulfide powder, the Sm—Co magnet powder, and the Sm—FE—N magnet powder was 12 wt % to 46.5 wt % to 41.5 wt %.

A plastic magnet was obtained from the plastic magnet precursor using an injection molding machine shown in FIG.

1. The heating temperature of the heating zone A of the heating cylinder 7 was 290° C., the heating temperature of the heating zone B thereof was 300° C., and the heating temperature of the heating zone C, the reservoir zone 10, thereof was 310° C. A magnetic field of 1.5 T was applied to the mold 11. Further, the produced plastic magnet had the same size as that of Example 1.

As a comparative example, two kinds of the magnet powders coated with the above coupling agent and the activated thermoplastic resin powder, to which the above antioxidants were added, were kneaded and extruded into strands using a biaxial extruder, and pellets of the plastic magnet precursor were produced using a pelletizer. Injection molding was carried out similarly, using the pellets to produce a plastic magnet having the same size as that of Example 8.

Magnetic properties thereof are shown in Table 1 as Comparative Example 8.

As is apparent from the example, the plastic magnet of Example 8 excels in remanent magnetization, coercive force, and maximum energy product compared with that of Comparative Example 8. Therefore, it was found out that the plastic magnet of Example 8 excels in magnetic properties compared with that of Comparative Example 8.

The plastic magnet precursor of Example 8 includes the thermoplastic resin powder, which has an activated surface, bonded around two kinds of magnet powders through the coupling agent. Similar effects as those of Example 7 can be obtained.

EXAMPLE 9

Into a wholly aromatic polyester powder stirred at high speed, which is a thermoplastic resin powder, having a surface activated by a corona discharge treatment in which electrons generated by an applied voltage of 15 kV collide with the surface, 0.2 parts by weight of 3,3',3",5,5',5"-hexa-tert-butyl-a,a'a"-(mesitylene-2,4,6-triyl)tri-p-cresol was added with respect to 100 parts by weight of the resin. Then, an S—Fe—N anisotropic magnet powder having an average particle size of 5 μm, which is produced through a reduction-diffusion process, and an Nd—Fe—B isotropic magnet powder having an average particle size of 30 μm, which is produced by a liquid quenching method, both heated to 200° C., were added in an inert gas atmosphere. Then, the mixture was stirred at high speed for 10 minutes to produce a plastic magnet precursor for injection molding.

A weight ratio of the wholly aromatic polyester powder, the Sm—FE—N magnet powder, and the Nd—Fe—B magnet powder was 10 wt % to 45 wt % to 45 wt %.

A plastic magnet was obtained from the plastic magnet precursor using an injection molding machine shown in FIG. 1. The heating temperature of the heating zone A of the heating cylinder 7 was 260° C., the heating temperature of the heating zone B thereof was 260° C., and the heating temperature of the heating zone C, the reservoir zone 10, thereof was 270° C. A magnetic field of 1.5 T was applied to the mold 11. Further, the produced plastic magnet had the same size as that of Example 1.

As a comparative example, two kinds of the magnet powders and the activated thermoplastic resin powder, to which the above antioxidants were added, were Kneading and extruded into strands using a biaxial extruder, and pellets of the plastic magnet precursor were produced using a pelletizer. Injection molding was carried out similarly using the pellets to produce a plastic magnet having the same size as that of Example 9.

Magnetic properties thereof are shown in Table 1 as Comparative Example 9.

As is apparent from the example, the plastic magnet of Example 9 excels in remanent magnetization, coercive force, and maximum energy product compared with that of Comparative Example 9. Therefore, it was found out that the plastic magnet of Example 9 excels in magnetic properties compared with that of Comparative Example 9.

The plastic magnet precursor of Example 9 includes the thermoplastic resin powder 5, which has a surface activated by the corona discharge treatment, adhered around the magnet powders 1, and similar effects as those of Example 7 can be obtained.

The surface of the thermoplastic resin powder 5 may be activated through the corona discharge treatment at an applied voltage of 10 to 50 kV, preferably 15 to 30 kV, setting a distance to the thermoplastic resin powder as 2 to 30 mm.

Figure 15:
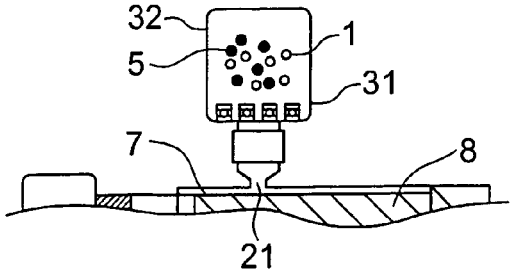
FIG. 15 is a partial structural diagram of an injection molding machine provided with a corona discharger.

A corona discharger 31 as an activation means may be provided in a feeder 32 which is directly connected to the heating cylinder 7 and charges raw materials into the heating cylinder 7 for activation treatment of the thermoplastic resin powder 5 as shown in FIG. 15.

The thermoplastic resin powder is not limited to the thermoplastic resin powders used in each of Examples. In addition, examples thereof may include: various polyamides (6, 11, 66, 46, 612, for example); liquid crystalline polymers such as thermoplastic polyimide, polybutylene terephthalate, and polyethylene terephthalate; polyolefins such as polyphenylene oxide, polyethylene, and polypropylene; polycarbonate; polymethyl methacrylate; polyether; and at least one kind of copolymers such as polyacetal and copolymers containing polyacetal or the like as a main component, a blend polymer, a polymer alloy, and a thermoplastic elastomer.

The coupling agent is not limited to the coupling agents used in each of Examples. In addition, examples thereof may include: titanate coupling agents such as isopropyltris(dioctylpyrophosphate) titanate, bis(dioctylpyrophosphate)oxyacetate titanate, isopropyltricumylphenyltitanate, dicumylphenyloxyacetate titanate; and silane coupling agents such as N-β-(aminoethyl)-γ-aminopropyl-trimethoxysilane, γ-aminopropyl-triethoxysilane, γmercaptopropyl-trimethoxysilane, and β-(3,4-epoxycyclohexyl)ethyl-trimethoxysilane.

The antioxidants, which are added and mixed in advance to the thermoplastic resin powder before mixing and stirring the thermoplastic resin powder and the magnet powder, are not limited to the antioxidants used in each of Examples. In addition, examples thereof may include: hindered phenol antioxidants such as pentaerythritoltetrakis[3-(3,5-di-tert-butyl-4-hydroxyphenyl) propionate], 3,5-bis(1,1-dimethyl-ethyl)-4-hydroxy-benzene propionate, and C7 to C9 side chain alkyl esters; phosphorus antioxidants such as bis[2,4-bis(1,1-dimethylethyl)-6-methylphenyl]ethylester phosphite; and lactone antioxidants such a reaction product of 3-hydroxy-5,7-di-tert-butylfuran-2-one and xylene.

Figure 7:
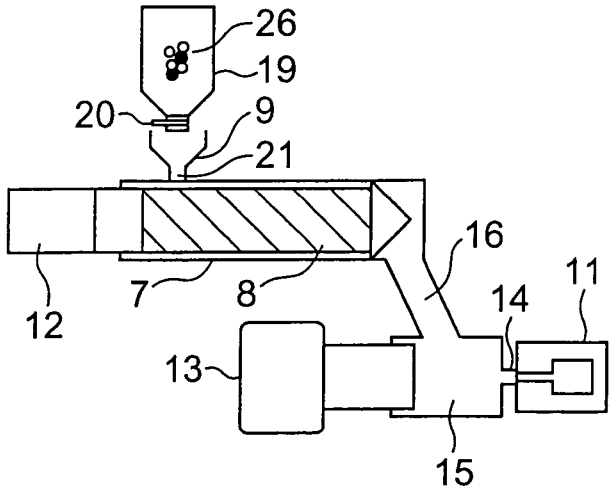
FIG. 7 is a structural diagram showing another example of an injection molding machine which produces a plastic magnet.

Further, for the injection molding machine, the reservoir zone 10 is not necessarily required to be provided in the front portion of the heating cylinder 7 and may be provided as a separate reservoir cylinder 15 with a heater outside the heating cylinder 7 as shown in FIG. 7.

In this case, a precursor 26 discharged to the front of the heating cylinder 7 by a screw 8 is filled in the reservoir cylinder 15 through a passage 16 with a heater. After an amount of the filling reaches a required amount, the precursor is pressurized through the pressurizing mechanism 13, and is spouted and injected inside the mold 11 from the injection port 14 at the tip of the reservoir cylinder 15.

The supply of the plastic magnet precursor from a storage tank 19 arranged above the hopper 9 to the hopper 9 can be carried out through a take out valve 20.

Figure 8:
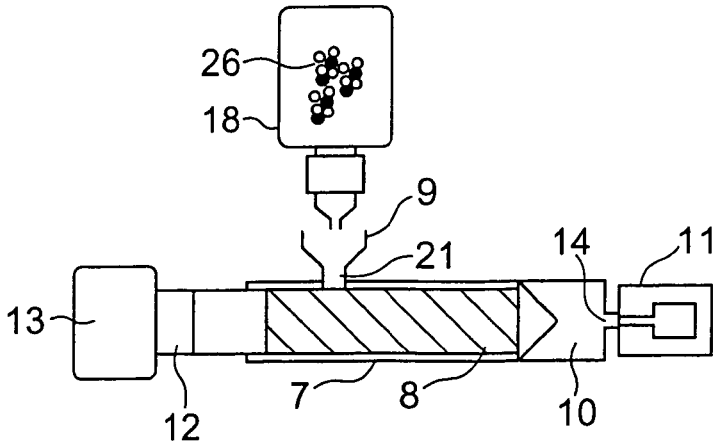
FIG. 8 is a structural diagram showing another example of an injection molding machine which produces a plastic magnet.

Further, a feeder 18 which has a function of controlling the rate of supply of a plastic magnet precursor 26 to the heating cylinder 7 and is capable of continuous supply can be used in place of the storage tank 19 as shown in FIG. 8 as well. The feeder 18 may also be directly installed on a side of the heating cylinder 7, and in this case, the hopper 9 is omitted.

Further, in this case, the plastic magnet precursor adhered to an inner wall can fall off by installing a vibration mechanism to the hopper 9 and the feeder 18.

Further, adhesion of the precursor to the inner wall may be prevented by coating the inner wall of the hopper 9 or the feeder 18 with a material having satisfactory slipping property, for example, a fluorine resin material.

Figure 9:
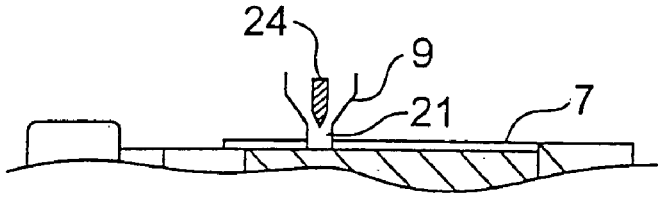
FIG. 9 is a structural diagram showing a main part of another example of an injection molding machine which produces a plastic magnet.

Further, by installing a screw 24 in the hopper 9, a bridge phenomenon of the plastic magnet precursor may be resolved, enabling a stable supply of the precursor to the heating cylinder 7 as shown in FIG. 9. For the screw 24, a better effect may be provided with a double screw compared to a single screw. Further, by installing the screw 24 also to the feeder 18, the bridge phenomenon of the precursor may be resolved, enabling a stable supply of the precursor to the heating cylinder 7.

Figure 10A:
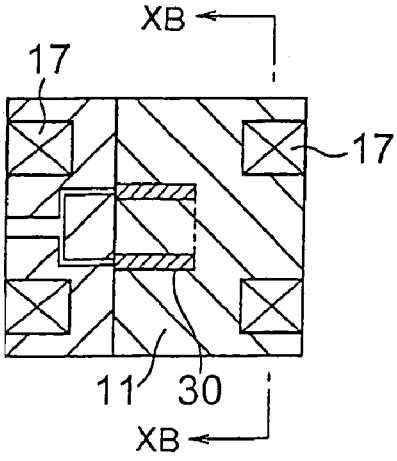
FIG. 10A is a vertical cross-sectional view of a mold.
Figure 10B:
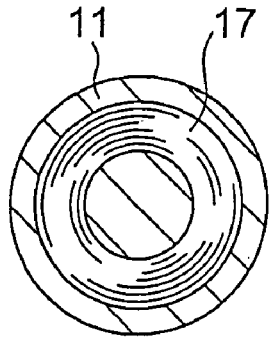
FIG. 10B is a vertical cross-sectional view taken on line XB-XB of FIG. 10A.

Further, for the mold 11, magnetic coils 17 are placed on both sides of a cylindrical mold product 30 as shown in FIGS. 10A and 10B. By generating a magnetic field in a radial direction to the mold product 30 through application of a current in an opposite direction to respective coils 17, a radial anisotropic ring plastic magnet can be molded.

Figure 11A:
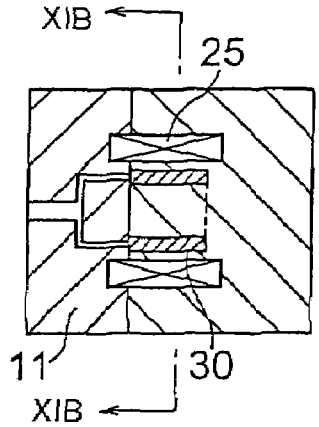
FIG. 11A is a vertical cross-sectional view of a mold.
Figure 11B:
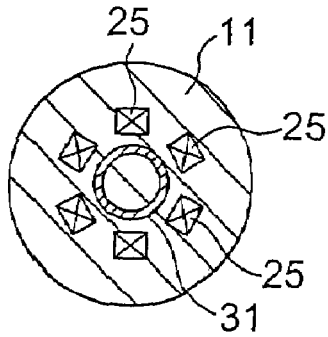
FIG. 11B is a vertical cross-sectional view taken on line XIB-XIB of FIG. 11A.

Further, by placing six permanent magnets 25 outside a cylindrical mold product 31 as shown in FIGS. 11A and 11B and producing magnetic fields of six patterns on the mold product 31, a mold of a six pole anisotropic plastic magnet can be obtained.

Advantages of using permanent magnets for the generation of magnetic fields include not requiring a current unlike an electromagnet, and a compact size of a magnetic circuit.

Further, Example 2 described a product obtained by mixing and stirring the plastic magnet precursor produced in Example 1 and the return material thereof. However, a conventional compound or a composite, which is a return material, can be charged inside the heating cylinder 7 along with the plastic magnet precursor produced in each of Examples. The return material is obtained by processing the sprue runner generated in injection molding to a crushed piece or a pulverized powder using a crusher or a pulverizer and can be reused as an injection material. Further, the plastic magnet produced by injection molding can be similarly used as a return material by processing to a crushed piece or a pulverized powder using a crusher or a pulverizer.

When charging the composite into the heating cylinder 7 along with the plastic magnet precursor, both can be mixed in advance and, for example, the mixture can be poured from the hopper 9 shown in FIG. 1. The composite and the plastic, magnet precursor are supplied in a state of being mutually and uniformly dispersed. Therefore, the plastic magnet precursor and the composite are uniformly mixed inside the heating cylinder 7. Further, by using a powder-type composite, a state of higher mutual dispersibility with the plastic magnet precursor can be obtained compared to a case of using a flaky or particulate composite.

The supply of the mixture to the hopper 9 can be carried out manually, and in addition, from the storage tank 19 through the take out valve 20 as shown in FIG. 7. Further, the feeder 18 can be used as shown in FIG. 8.

Figure 12:
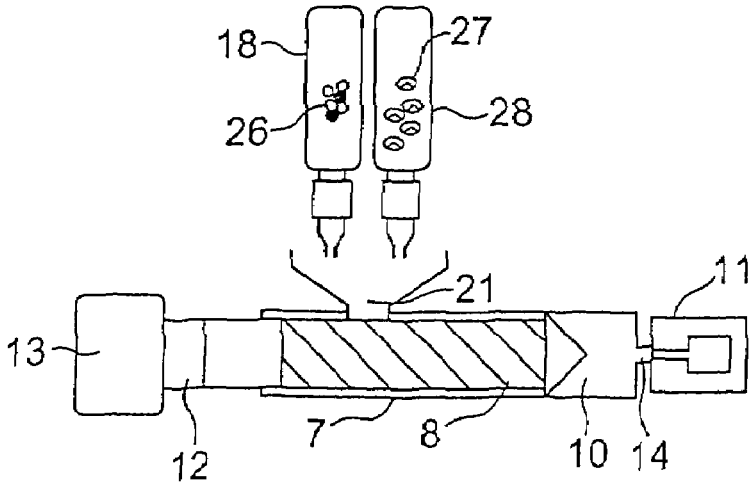
FIG. 12 is a structural diagram showing another example of an injection molding machine which produces a plastic magnet.

Further, the injection molding machine may be provided with a feeder 28 of a composite 27 in addition to the feeder 18 of the plastic magnet precursor 26 to share a discharge port 21 to the heating cylinder 7 as shown in FIG. 12. According to the example, a mixture of the composite and the plastic magnet precursor does not have to be produced in advance, and a charging ratio of both components can be actively controlled.

Figure 13:
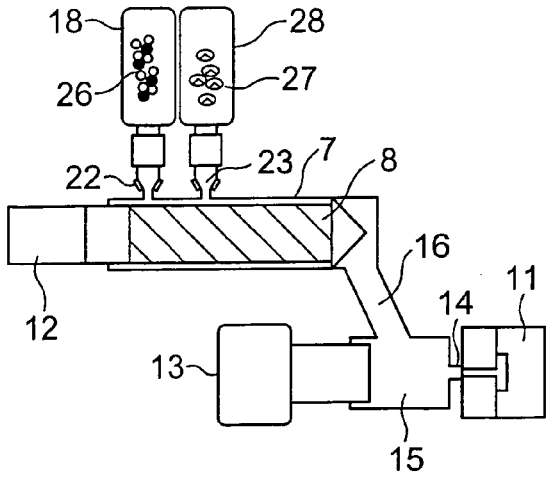
FIG. 13 is a structural diagram showing another example of an injection molding machine which produces a plastic magnet.

As shown in FIG. 13, the feeder 28 for the composite and the feeder 18 for the plastic magnet precursor may be directly connected to the heating cylinder 7.

What is claimed is:

1. A plastic magnet precursor comprising a thermoplastic resin powder and at least one magnet powder, wherein said resin powder adheres around the magnet powder, and the at least one magnet powder is coated with a coupling agent which bonds the magnet powder and the thermoplastic resin powder.

2. A plastic magnet precursor comprising a thermoplastic resin powder, at least one magnet powder, and an antioxidant which prevents oxidation of the thermoplastic resin powder, wherein the resin powder is melted at a surface that contacts the magnet powder to adhere said magnet powder around the resin powder.

3. A plastic magnet precursor comprising a thermoplastic resin powder and at least one magnet powder, wherein said magnet powder adheres around the resin powder and the at least one magnet powder is coated with a coupling agent which bonds the magnet powder and the thermoplastic resin powder.

4. The plastic magnet precursor according to claim 1 further comprising an antioxidant which prevents oxidation of the thermoplastic resin powder.

5. The plastic magnet precursor according to claim 1 further comprising a metal deactivator which prevents the magnet powder from oxidizing the thermoplastic resin powder.

6. The plastic magnet precursor according to claim 2 further comprising a metal deactivator which prevents the magnet powder from oxidizing the thermoplastic resin powder.

7. The plastic magnet precursor according to claim 3 further comprising an antioxidant which prevents oxidation of the thermoplastic resin powder.

8. The plastic magnet precursor according to claim 3 further comprising a metal deactivator which prevents the magnet powder from oxidizing the thermoplastic resin powder.

* * * * *